US011333375B2

(12) United States Patent
Nishimura et al.

(10) Patent No.: US 11,333,375 B2
(45) Date of Patent: May 17, 2022

(54) AIR CONDITIONER

(71) Applicant: SHINWA CONTROLS CO., LTD, Kawasaki (JP)

(72) Inventors: Kenji Nishimura, Kawasaki (JP); Yasuhiro Naohara, Kawasaki (JP)

(73) Assignee: Shinwa Controls Co., Ltd, Kawasaki (JP)

( * ) Notice: Subject to any disclaimer, the term of this patent is extended or adjusted under 35 U.S.C. 154(b) by 238 days.

(21) Appl. No.: 16/487,921

(22) PCT Filed: Dec. 5, 2017

(86) PCT No.: PCT/JP2017/043714
§ 371 (c)(1),
(2) Date: Aug. 22, 2019

(87) PCT Pub. No.: WO2018/154909
PCT Pub. Date: Aug. 30, 2018

(65) Prior Publication Data

US 2019/0383502 A1 Dec. 19, 2019

(30) Foreign Application Priority Data

Feb. 23, 2017 (JP) ..... JP2017-032464

(51) Int. Cl.
*F24F 6/02* (2006.01)
*F24F 13/22* (2006.01)
*F24F 6/00* (2006.01)

(52) U.S. Cl.
CPC ..... *F24F 6/02* (2013.01); *F24F 13/222* (2013.01); *F24F 2006/008* (2013.01); *F24F 2013/225* (2013.01); *F24F 2013/227* (2013.01)

(58) Field of Classification Search
CPC ..... F24F 6/02; F24F 13/222; F24F 2013/225; F24F 2013/227; F24F 2006/008
See application file for complete search history.

(56) References Cited

U.S. PATENT DOCUMENTS

2014/0182705 A1* 7/2014 Kaiser ..... B08B 9/0325 137/238
2018/0238580 A1 8/2018 Ikeda et al.

FOREIGN PATENT DOCUMENTS

CN 202532640 U * 11/2012
CN 202532640 U 11/2012
(Continued)

OTHER PUBLICATIONS

Japanese Office Action (Application No. 2017-032464) dated Mar. 24, 2017.

(Continued)

*Primary Examiner* — Lionel Nouketcha
(74) *Attorney, Agent, or Firm* — Burr & Brown, PLLC

(57) ABSTRACT

An air conditioner is provided, including an air flow path, a cooling unit disposed in the air flow path that cools air introduced into the air flow path to condense vapor contained in the air, and a humidification unit that humidifies the air and which includes a storage tank for storing water and a heater for heating water in the storage tank. A discharged-water storage unit is also provided, which stores water discharged from the cooling unit and water discharged from the humidification unit, and an exhaust pipe is connected to the storage tank and configured to discharge water in the storage tank to the discharged-water storage unit. An exhaust valve is disposed midway on the exhaust pipe, and an overflow pipe connects the storage tank and a part of the exhaust pipe on the downstream side of the exhaust valve.

6 Claims, 4 Drawing Sheets

(56) References Cited

FOREIGN PATENT DOCUMENTS

| | | | | |
|---|---|---|---|---|
| CN | 203478565 | U | * | 3/2014 |
| CN | 203478565 | U | | 3/2014 |
| GB | 1 578 269 | A | | 11/1980 |
| JP | S51-037764 | U | | 3/1976 |
| JP | H06-288566 | A1 | | 10/1994 |
| JP | H09-243145 | A1 | | 9/1997 |
| JP | 2001-141257 | A1 | | 5/2001 |
| JP | 2005-207706 | A1 | | 8/2005 |
| JP | 2013-053767 | A1 | | 3/2013 |
| JP | 5886463 | | | 3/2016 |
| JP | 2016-114278 | A1 | | 6/2016 |

OTHER PUBLICATIONS

Japanese Office Action (Application No. 2017-032464) dated Jun. 9, 2017.
International Search Report and Written Opinion (Application No. PCT/JP2017/043714) dated Feb. 6, 2018.
Extended European Search Report (Application No. 17897238.6) dated Oct. 26, 2020.
Chinese Office Action (Application No. 201780087058.6) dated Jul. 17, 2020.
English translation of International Preliminary Report on Patentability (Chapter I) (Application No. PCT/JP2017/043714) dated Sep. 6, 2019, 6 pages.

* cited by examiner

AIR CONDITIONER

FIELD OF THE INVENTION

The present invention relates to an air conditioner.

BACKGROUND OF THE INVENTION

In a manufacturing step of semiconductors, an air conditioner has been conventionally used for precisely controlling a temperature and a humidity of an atmosphere. For example, JP 5886463 B1 discloses an air conditioner comprising a cooling unit that cools and dehumidifies air having been introduced into the air conditioner, a heating unit that heat air having passed through the cooling unit up to a predetermined temperature, and a humidification unit (humidification device) that humidifies air having passed through the heating unit.

In the air conditioner of JP 5886463 B1, when air having been introduced into the air conditioner is cooled in the cooling unit, vapor contained in the air is condensed into water droplets which adhere to the cooling unit. Thus, the air having been introduced into the air conditioner is cooled and dehumidified. The water droplets adhering to the cooling unit generally fall down to a drain pan disposed below the cooling unit so as to be discharged to the outside of the air conditioner through an exhaust pipe connected to the drain pan.

The humidification unit has a storage tank for storing water and a heater disposed in the storage tank. Water stored in the storage tank is heated by the heater so as to be evaporated to generate vapor, so that air passing above the storage tank is humidified. A temperature of the heater is controlled such that a desired amount of vapor can be generated. A water supply means having a water supply pipe and a valve, such as an electromagnetic valve, is connected to the storage tank. In the storage tank, a detector for detecting a liquid level of water stored therein is disposed. Thus, the liquid level height is controlled within a predetermined range. Namely, when the detector detects that a liquid level in the storage tank falls below a lower limit of the predetermined range because the water is evaporated by being heated by the heater, the valve of the water supply means is released so as to supply the storage tank with water through the water supply pipe.

Thus, during a normal operation of the air conditioner, water is not discharged from the humidification unit. However, upon maintenance operation or long-term suspension, water in the humidification unit is discharged. In this case, water in the storage tank is manually moved by an operator to a container such as a bucket through an exhaust pipe connected to the storage tank. However, in this method, not only labor of an operator increases, but also the discharge operation is time-consuming, resulting in lowering of operation efficiency.

In addition, in order to allow a humidification unit to be operated more stably, the inventors of the present invention consider that a humidification unit is equipped with an overflow path, and that, when a liquid level of water in the storage tank exceeds a predetermined range because of trouble of a water supply valve or a detector, water is discharged from the overflow path. In this case, the air conditioner is required to have a means for discharging water in the storage tank of the humidification unit, without any manual operation of an operator.

In order to solve these problems, it is possible to provide a means dedicated for automatically discharging water in the storage tank to the outside of the air conditioner. However, in this case, the number of components constituting the air conditioner increases, and the air conditioner enlarges as a whole.

SUMMARY OF THE INVENTION

The present invention has been made in view of the above circumstances. The object of the present invention is to provide an air conditioner equipped with a means for discharging water stored in a humidification unit, while increase in the number of components constituting the air conditioner and enlargement of the air conditioner can be avoided.

The air conditioner of the present invention comprising:

an air flow path;

a cooling unit disposed in the air flow path, the cooling unit being configured to cool air introduced into the air flow path so as to condense vapor contained in the air;

a humidification unit that humidifies the air, the humidification unit including a storage tank for storing water and a heater for heating water in the storage tank;

a discharged-water storage unit capable of storing water discharged from the cooling unit and water discharged from the humidification unit; and an exhaust pipe connected to the storage tank, the exhaust pipe being configured to discharge water in the storage tank to the discharged-water storage unit; and an exhaust valve disposed midway on the exhaust pipe;

wherein the air conditioner further comprises an overflow pipe that connects the storage tank and a part of the exhaust pipe on the downstream side of the exhaust valve.

In the air conditioner of the present invention, the discharged-water storage unit may be a drain pan disposed below the cooling unit.

In the air conditioner of the present invention, a bottom wall of the discharged-water storage unit may be inclined with respect to a horizontal plane.

The air conditioner of the present invention may further comprise a water level detector that detects a water level in the discharged-water storage unit.

The air conditioner of the present invention may further comprise a pump that discharges water stored in the discharged-water storage unit.

In the air conditioner of the present invention, the pump may be a diaphragm-type pump.

According to the present invention, it is possible to provide an air conditioner equipped with a means for discharging water stored in a humidification unit, while increase in the number of components constituting the air conditioner and enlargement of the air conditioner can be avoided.

DETAILED DESCRIPTION OF THE INVENTION

Figure 1:
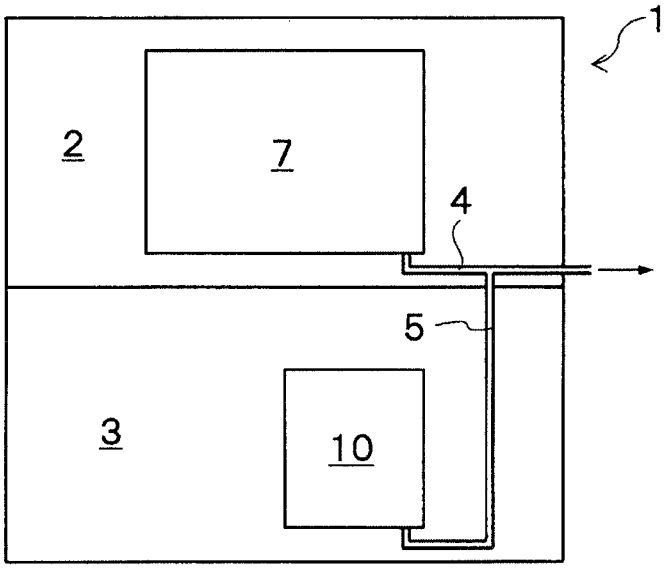
FIG. 1 is a view for describing an embodiment of the present invention, schematically showing an example of a semiconductor device manufacturing plant where an air conditioner is installed.

Herebelow, an embodiment of the present invention is described with reference to the drawings. In the drawings attached to the specification, a scale size, an aspect ratio and so on are changed and exaggerated from the actual ones, for the convenience of easiness in illustration and understanding.

Further, terms specifying shapes, geometric conditions and their degrees, e.g., "parallel", "orthogonal", "same", etc. and a value of a length, an angle, etc., are not limited to their strict definitions, but are to be construed to include a range capable of exerting a similar function.

Figure 2:
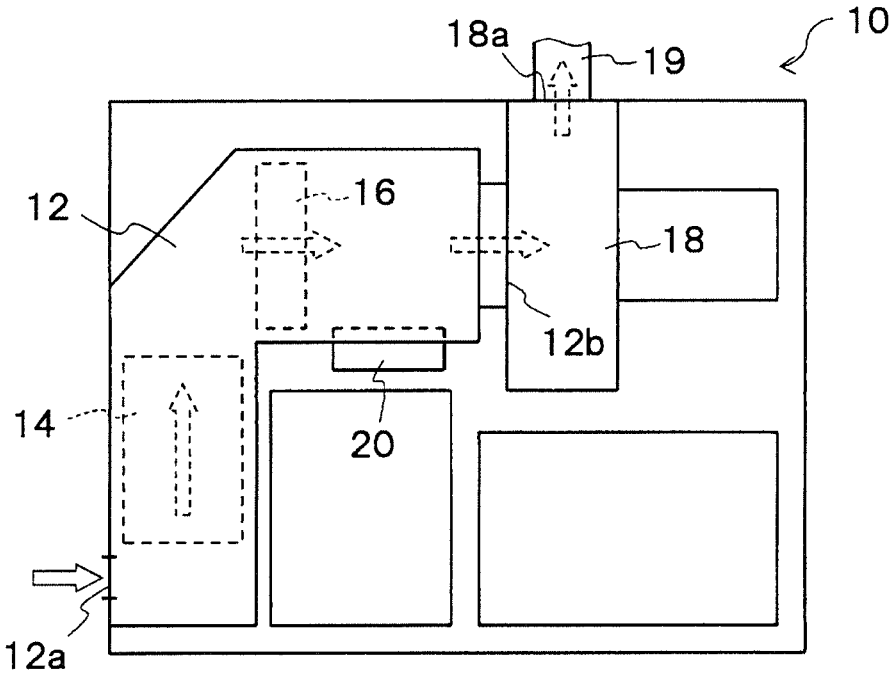
FIG. 2 is a view schematically showing an example of the air conditioner.
Figure 3:
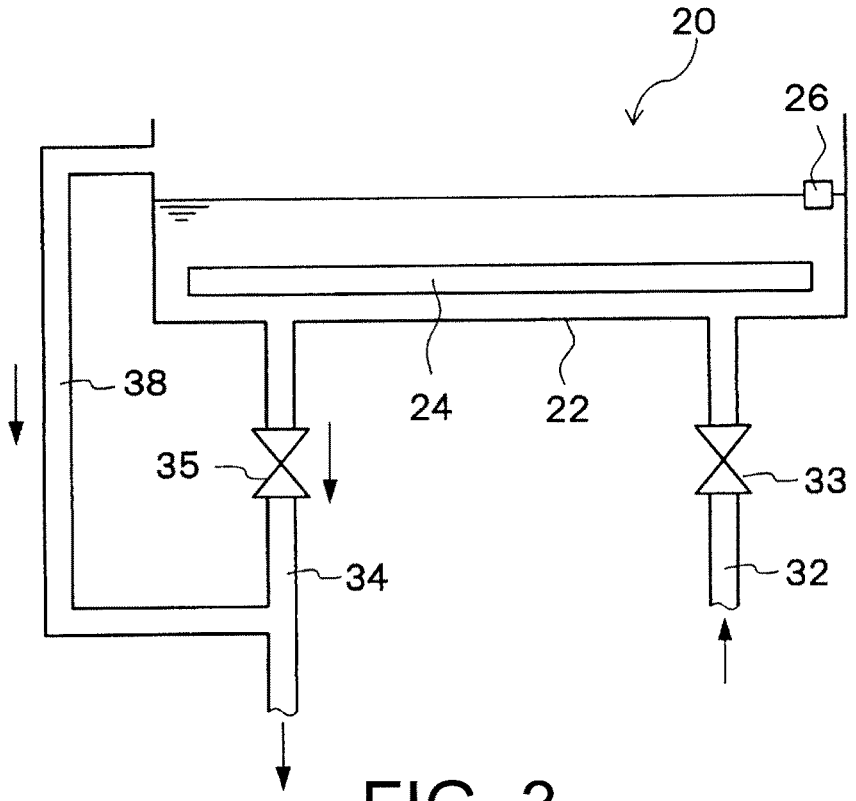
FIG. 3 is a view showing a humidification unit of the air conditioner.
Figure 4:
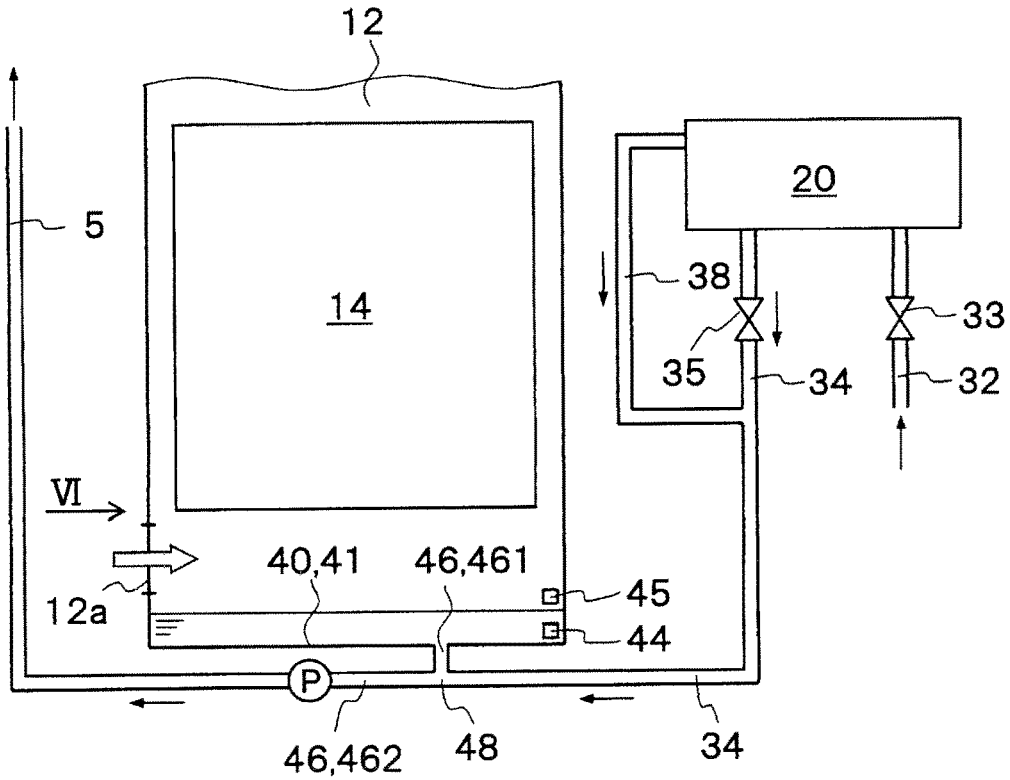
FIG. 4 is a view for showing a cooling unit, the humidification unit and a discharged-water storage unit of the air conditioner.

FIGS. 1 to 4 are views for describing an embodiment of the present invention. FIG. 1 is a view for describing an embodiment of the present invention, schematically showing an example of a semiconductor device manufacturing plant where an air conditioner is installed. FIG. 2 is a view schematically showing an example of the air conditioner. FIG. 3 is a view showing a humidification unit of the air conditioner. FIG. 4 is a view for showing a cooling unit, the humidification unit and a discharged-water storage unit of the air conditioner.

The semiconductor device manufacturing plant 1 shown in FIG. 1 has an upstairs part 2 and a downstairs part 3. A semiconductor device manufacturing apparatus 7 is installed in the upstairs part 2 of the semiconductor device manufacturing plant 1. An air conditioner 10 that controls a temperature and a humidity of air and delivers the air to the semiconductor device manufacturing apparatus 7 is installed in the downstairs part 3. Herein, the upstairs part 2 means an upper floor part relative to the downstairs part 3. The upstairs part 2 may not only be positioned directly above the downstairs part 3, but may also be horizontally shifted from the downstairs part 3. In addition, another space (floor) may be disposed between the upstairs part 2 and the downstairs part 3.

The semiconductor device manufacturing apparatus 7 is an apparatus that performs at least one step of respective steps for manufacturing a semiconductor device. For example, the semiconductor manufacturing apparatus 7 can be structured as an apparatus for performing a pattern forming step of a semiconductor device. In the pattern forming step of a semiconductor device, a photoresist material is firstly applied onto a semiconductor substrate, and then the resist material is exposed through a photomask (reticle). When the photoresist material is a positive-type material, an area to be removed in a succeeding development step is exposed. On the other hand, when the photoresist material is a negative-type material, an area to be left in the development step is exposed. Then, an exposed area or an unexposed area in the resist material is removed by a solvent or the like. Thus, a resist pattern having a pattern corresponding to the exposure pattern is formed on the semiconductor substrate. Thereafter, the semiconductor substrate is etched by plasma etching with the resist pattern as a mask. Thus, a semiconductor device having a pattern corresponding to the resist pattern is manufactured.

In the semiconductor device manufacturing step in the semiconductor device manufacturing apparatus 7, a temperature and a humidity of an atmosphere are required to be precisely controlled. Thus, the air conditioner 10 is installed in the semiconductor device manufacturing plant 1. Air whose temperature and humidity are precisely controlled by the air conditioner 10 is delivered to the semiconductor device manufacturing apparatus 7. In the example shown in FIG. 1, water discharged from the semiconductor device manufacturing apparatus 7 is discharged to the outside of the semiconductor device manufacturing plant 1 through an upstairs exhaust pipe 4 disposed in the upstairs part 2. In the present case, for example, an exhaust means communicated with the outside of the semiconductor device manufacturing plate 1 is not installed in the downstairs part 3, as described above. Thus, the semiconductor device manufacturing plant 1 is equipped with a downstairs exhaust pipe 5 that extends from the downstairs part 3 to the upstairs part 2 so as to be connected to the upstairs exhaust pipe 4 in the upstairs part 2. Water discharged from the air conditioner 10 is discharged to the outside of the semiconductor device manufacturing plant 1 through the downstairs exhaust pipe 5 and the upstairs exhaust pipe 4.

In the example shown in FIG. 2, the air conditioner 10 comprises an air flow path 12 through which air passes, a cooling unit 14, a heating unit 16 and a humidification unit 20, which are sequentially disposed in the air flow path 12, and a blower 18 that drives air to pass through the air flow path 12. The air flow path 12 has an upstream opening 12*a* and a downstream opening 12*b*. The downstream opening 12*b* is in communication with the blower 18. The blower 18 has a fan, not shown. The fan is rotated by a not-shown drive source, such as a motor, so that air having been sucked into the air flow path 12 through the downstream opening 12*b* is discharged from a discharge outlet 18*a* toward a blower pipe 19. The blower pipe 19 extends from the air conditioner 10 to the semiconductor device manufacturing apparatus 7. Air discharged from the discharge outlet 18*a* of the air conditioner 10 is delivered to the semiconductor device manufacturing apparatus 7 through the blower pipe 19. Since the air in the air flow path 12 is sucked by the blower 18 through the downstream opening 12*b*, outside air is introduced into the air flow path 12 through the upstream opening 12*a*. Namely, the upstream opening 12*a* functions as an air introduction port for introducing outside air into the air flow path 12. The upstream opening 12*a* may be equipped with a filter device for removing dusts contained in outside air. In this specification, the term "upstream" means an upstream side of an air flow generated by the operation of the blower 18 in the air flow path 12, and the term "downstream" means a downstream side of an air flow generated by the operation of the blower 18 in the air flow path 12. In FIG. 2, an air flowing direction in the air conditioner 10 is shown by arrows.

The cooling unit 14 is disposed in the air flow path 12, and has a function for cooling air introduced into the air flow path 12 so as to condense vapor contained in the air. The cooling unit 14 in this embodiment has a variable refrigeration capacity, and may be for example, an evaporator in a cooling circuit in which a compressor, a condenser, an expansion valve and an evaporator are connected in this order through pipes so that a heating medium circulates therethrough. However, the cooling unit 14 may not necessarily have a variable refrigeration capacity. Air having been introduced into the air flow path 12 through the upstream opening 12*a* comes into contact with the cooling unit 14 so as to be cooled, and goes toward the heating unit 16 positioned on the downstream side of the cooling unit 14. When the air having been introduced into the air flow path 12 is cooled by the cooling unit 14, vapor contained in the air is condensed into water droplets which adhere to the cooling unit 14. In this embodiment, the water droplets adhering to the cooling unit 14 fall down to a drain pan 41 disposed below the cooling unit 14.

The heating unit 16 has a variable heating capacity, and has a function for heating air that has been cooled and dehumidified by the cooling unit 14. However, the heating unit 16 may not necessarily have a variable heating capacity. The heating unit 16 is disposed on the downstream side of the cooling unit 14 in the air flow path 12. An electric heater may be used as the heating unit 16, for example. Not limited thereto, the heating unit 16 may use at least a part of heat of a heating medium that has a high temperature in the aforementioned cooling circuit. Air having passed through the cooling unit 14 comes into contact with the heating unit 16 so as to be heated. At this time, since an amount of saturated vapor in the air heated by the heating unit 16 increases, a humidity that is a ratio of an amount of vapor actually contained in the amount of the saturated vapor decreases.

Next, the humidification unit 20 is described with reference to FIGS. 2 and 3. The humidification unit 20 is disposed for humidifying air that has been heated by the heating unit 16 so that its humidity has lowered. Thus, the humidification unit 20 is disposed on the downstream side of the heating unit 16. Particularly in the example shown in FIG. 2, the humidification unit 20 is disposed between the heating unit 16 and the downstream opening 12*b*. In the example shown in FIG. 3, the humidification unit 20 has a storage tank 22 for storing water, which is opened upward into the air flow path 12, a heater 24 that is accommodated in the storage tank 22 so as to heat water in the storage tank 22, and a water level detector 26 for detecting a water level height in the storage tank 22.

The storage tank 22 is a container for containing water for use in humidifying air. The storage tank 22 has a box-like shape with an opened upper surface, and is formed of a stainless plate member. In the example shown in FIG. 2, a part of the storage tank 22 projects to the outside of the air flow path 12. However, not limited thereto, the storage tank 22 may be accommodated inside the air flow path 12 as a whole, or the storage tank 22 may be disposed outside the air flow path 12 as a whole, and the upper opening of the storage tank 22 may be communicated with the air flow path 12.

The heater 24 is an electric heater, for example, and is used for heating water in the storage tank 22 so as to generate vapor. A heating amount of the heater 24 is adjustable, so that an amount of vapor generated from water stored in the storage tank 22 can be adjusted. Thus, a humidity of air passing through the air flow path 12 can be adjusted into a desired humidity.

A supply pipe 32 for supplying water into the storage tank 22 is connected to the storage tank 22. A supply valve 33 is disposed midway on the supply pipe 32. The supply pipe 32 is connected to a water supply source, not shown, at an end opposed to the end connected to the storage tank 22. Thus, by opening the supply valve 33, water can be supplied from the supply source into the storage tank 22 through the supply pipe 32. In addition, by closing the supply valve 33, supply of water from the supply source into the storage tank 22 can be stopped. An electromagnetic valve may be used as the supply valve 33, for example.

A water level detector 26 is a float switch, for example, and is used for detecting a water level height in the storage tank 22. When the water level detector 26 detects that the water level height in the storage tank 22 becomes lower than a predetermined height, the supply valve 33 is opened by a not-shown control unit so that supply of water into the storage tank 22 is started. Thus, the water level height in the storage tank 22 becomes elevated. When the water level detector 26 detects that the water level height in the storage tank 22 becomes the predetermined height, the supply valve 33 is closed by the control unit so that the supply of water from the supply source into the storage tank 22 is stopped. Thus, the water level height in the storage tank 22 can be constantly maintained within a predetermined range.

An exhaust pipe (second exhaust pipe) 34 for discharging water in the storage tank 22 is connected to the storage tank 22. An exhaust valve 35 is disposed midway on the exhaust pipe 34. The exhaust pipe 34 is connected to a below-described exhaust pipe (first exhaust pipe) 46 at an end opposed to the end connected to the storage tank 22. By opening the exhaust valve 35, water can be discharged from the storage tank 22 to a discharged-water storage unit 40 through the exhaust pipe 34 and a first part 461 of the exhaust pipe 46. In addition, by closing the exhaust valve 35, discharge of water from the storage tank 22 to the discharged-water storage unit 40 can be stopped. A manual switching valve or an electromagnetic valve may be used as the exhaust valve 35, for example. When water in the storage tank 22 is desired to be discharged in order to perform a maintenance operation of the humidifying unit 20, in order to prevent deterioration of water in the storage tank 22 during a long-term suspension, or another reason, by opening the exhaust valve 35, the water can be discharged from the storage tank 22 to the discharged-water storage unit 40 through the exhaust pipe 34 and the first part 461.

In the example shown in FIGS. 3 and 4, an overflow pipe 38 is connected to the storage tank 22. One end of the overflow pipe 38 is opened above the water level detector 26 in the storage tank 22, and the other end thereof is connected midway to the exhaust pipe 34. Particularly in the illustrated example, the other end of the overflow pipe 38 is connected to a portion that is positioned downstream side of the exhaust valve 35 of the exhaust pipe 34, i.e., a portion that is positioned oppositely to the storage tank 22 with respect to the exhaust valve 35. In this case, water having flown from the storage tank 22 into the overflow pipe 38 goes toward the discharged-water storage unit 40 without passing through the exhaust valve 35.

In the humidifying unit 20, if supply of water into the storage tank 22 cannot be stopped because of trouble of the supply valve 33 or the water level detector 26, there is a possibility that the water overflows from the storage tank 22 to enter surrounding units so that the units are damaged. In order to prevent such a problem, in the humidification unit in this embodiment, the overflow pipe 38 serving as an overflow path is connected to the storage tank 22. When the liquid level height in the storage tank 22 becomes higher than the predetermined range because of trouble of the supply valve 33 or the water level detector 26, water in the storage tank 22 is discharged to the below-described discharged-water storage unit 40 through the overflow pipe 38, the exhaust pipe 34 and the below-described first part 461 of the exhaust pipe 46. Thus, even when supply of water into the storage tank 22 cannot be stopped because of trouble of the supply valve 33 or the water level detector 26, it can be prevented that the water overflows from the storage tank 22 to enter surrounding units so that the units are damaged, and the air conditioner 10 can have stability in operation.

Next, the discharged-water storage unit 40 is described. The discharged-water storage unit 40 is disposed for storing water discharged from the cooling unit 14 and the water discharged from the humidification unit 20. In the example shown in FIG. 4, the discharged-water storage unit 40 is structured as the drain pan 41 disposed below the cooling unit 14. The exhaust pipe (first exhaust pipe) 46 for discharging water stored in the discharged-water storage unit 40 is connected to the discharged-water storage unit 40 (drain pan 41). In the illustrated example, the air conditioner 10 has a pump P for discharging water stored in the discharged-water storage unit 40. The exhaust pipe 46 is connected to the pump P at an end opposed to the end connected to the discharged-water storage unit 40. In the illustrated example, the exhaust pipe (second exhaust pipe) 34 for discharging water in the storage tank 22 of the humidification unit 20 is connected to the exhaust pipe 46 at a connection 48 positioned at an intermediate portion of the exhaust pipe 46. Thus, the exhaust pipe 46 has the first part 461 that extends from the discharged-water storage unit 40 to the connection 48, and a second part 462 that extends from the connection 48 to the pump P. As described above, water droplets adhering to the cooling unit 14 fall down into the discharged-water storage unit 40 disposed below the cooling unit 14 so as to be stored in the discharged-water storage unit 40. In addition, water discharged from the storage tank 22 of the humidification unit 20 flows into the discharged-water storage unit 40 so as to be stored therein through the exhaust pipe 34 and the exhaust pipe 46 (first part 461) or through the overflow pipe 38, the exhaust pipe 34 and the exhaust pipe 46 (first part 461).

In the example shown in FIG. 4, liquid level detectors 44, 45 that detect water levels in the discharged-water storage unit 40 are disposed in the discharged-water storage unit 40. Particularly in the illustrated example, in the discharged-water storage unit 40, there are a lower water level detector 44 disposed relatively below, and a higher water level detector 45 disposed relatively above. Float switches may be used as the water level detectors 44, 45, for example.

In the illustrated example, the exhaust pipe 46 (second part 462) and the downstairs exhaust pipe 5 are connected by the pump P. When the pump P is activated, water in the discharged-water storage unit 40 is delivered toward the downstairs exhaust pipe 5. In this embodiment, the pump P is activated based on a water level detection by each of the water level detectors 44, 45, so that water in the discharged-water storage unit 40 is discharged.

The higher water level detector 45 is disposed below a lower end of the upstream opening 12*a* of the air flow path 12, i.e., at a lower position. In this case, when the pump P is activated based on the detection of a water level by the higher water level detector 45 so as to discharge water in the discharged-water storage unit 40, water in the discharged-water storage unit 40 can be prevented from overflowing from the upstream opening 12*a* of the air flow path 12. The lower water level detector 44 is preferably disposed such that it can detect a water level at a position as low as possible in the discharged-water storage unit 40.

Figure 5:
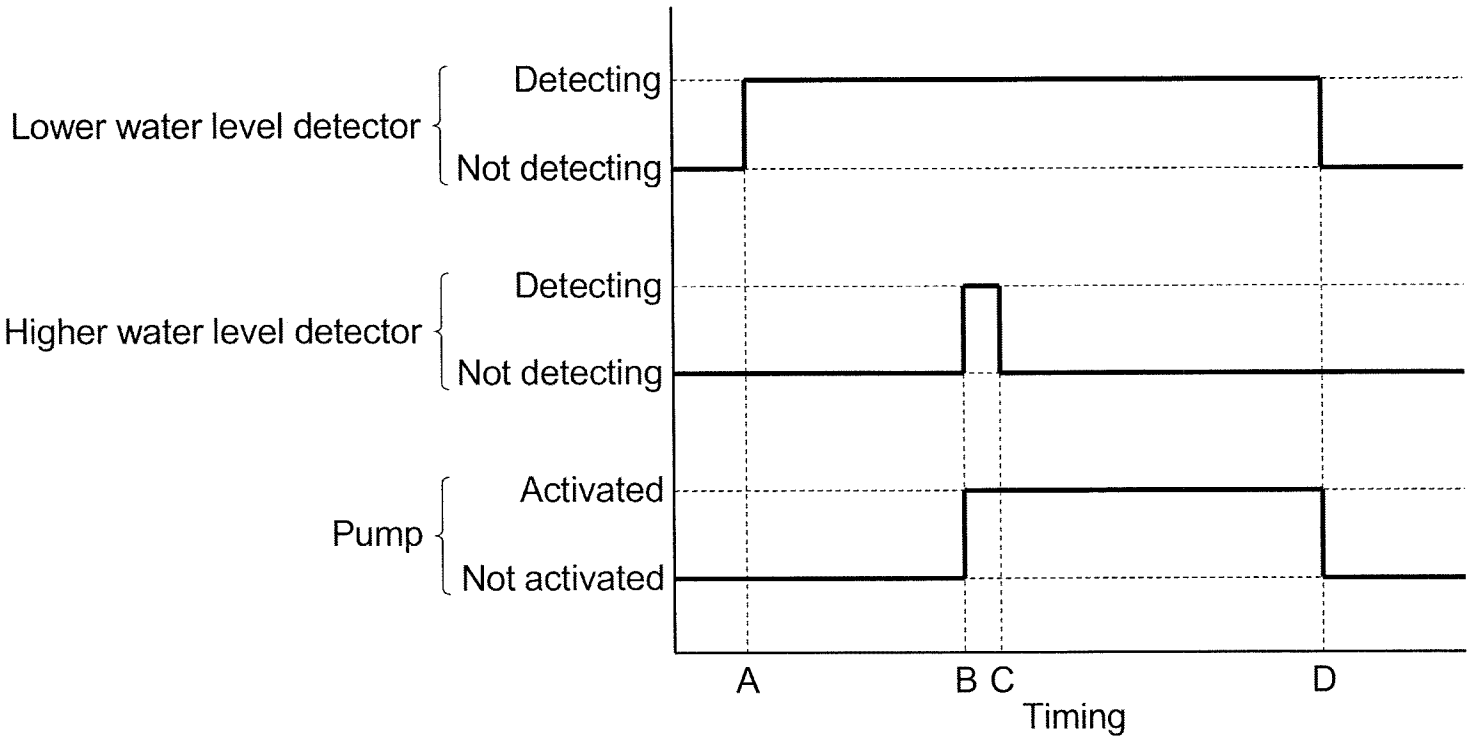
FIG. 5 is a view for describing operation timings of a pump for discharging water stored in the discharged-water storage unit.

Activation of the pump P based on detection of water level by each water level detector 44, 45 is described in detail with reference to FIG. 5. When no water is stored in the discharged-water storage unit 40, both the water level detectors 44, 45 do not detect a water level, whereby the pump P is not activated. When water discharged from the cooling unit 14 and/or water discharged from the humidification unit 20 flows into the discharged-water storage unit 40 so that a water level becomes elevated, the lower water level detector 44 firstly detects the water level (timing A). When the water level in the discharged-water storage unit 40 becomes further elevated, the higher water level detector 45 then detects the water level (timing B). When the not-shown control unit receives a signal informing the detection of the water level from the higher water level detector 45, the control unit activates the pump P so that the water in the discharged-water storage unit 40 is discharged through the exhaust pipe 46 toward the downstairs exhaust pipe 5. When the water level in the discharged-water storage unit 40 lowers by the activation of the pump P, the higher water level detector 45 does not detect the water level any more (timing C). Even when the higher water level detector 45 does not detect the water level, the pump P is continuously activated. When the water level in the discharged-water storage unit 40 further lowers, the lower water level detector 44 does not detect the water level any more. When the control unit receives a signal informing that the water level is not detected from the lower water level detector 44, or when a signal informing the detection of the water level from the lower level detector 44 stops, the control unit stops the pump P (timing D). Thus, in the air conditioner 10 according to this embodiment, discharge of water stored in the discharged-water storage unit 40 is controlled such that, when a water level in the discharged-water storage unit 40 reaches a predetermined higher level, discharge of water from the discharged-water storage unit 40 is started, and that, when a water level in the discharged-water storage unit 40 reaches a predetermined lower level, discharge of water from the discharged-water storage unit 40 is stopped. The predetermined lower level means a position that is relatively lower than the predetermined higher level.

Figure 6:
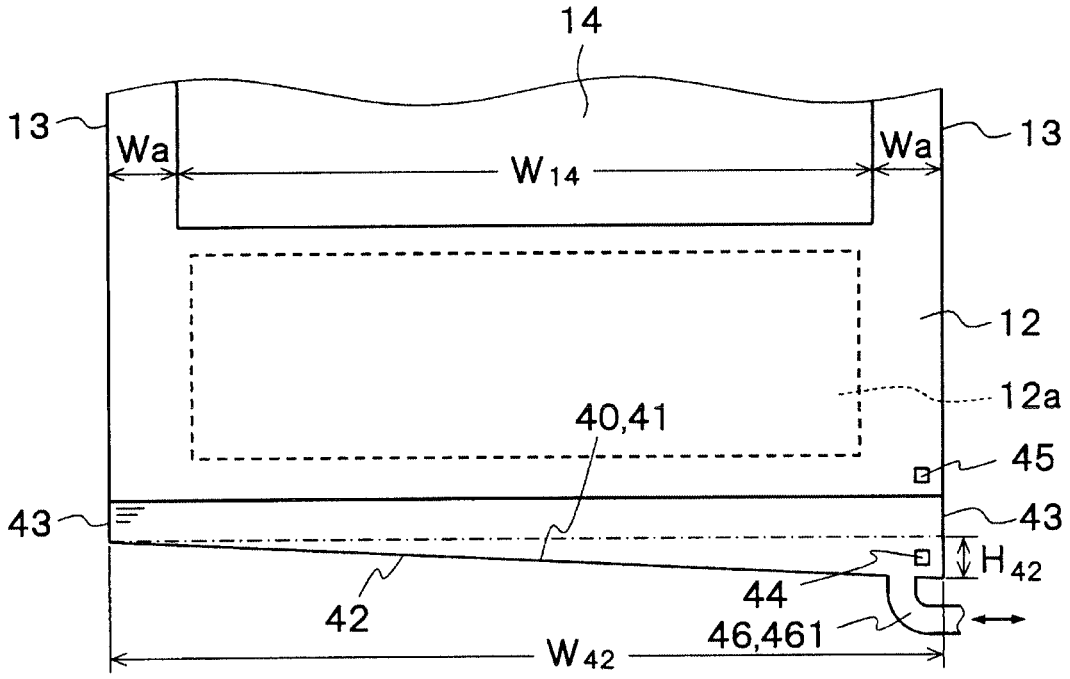
FIG. 6 is an enlarged sectional view of the discharged-water storage unit seen along an arrow VI of FIG. 4.

FIG. 6 is a view seen along an arrow VI of FIG. 4, which shows an enlarged sectional view of the discharged-water storage unit 40. In FIG. 6, an area corresponding to the upstream opening 12 of the air flow path 12 is shown by broken lines.

In the example shown in FIG. 6, the discharged-water storage unit 40 (drain pan 41) has a bottom wall 42, and a sidewall 43 standing up from a periphery of the bottom wall 42. In the illustrated example, the bottom wall 42 is inclined with respect to a horizontal plane, such that one side (right side in FIG. 6) in a width direction (right and left direction in example shown in FIG. 6) is lowered. The term "width direction" herein includes all the directions orthogonal to the vertical direction (up and down direction in FIG. 6). Namely, the bottom wall 42 is not limited to the bottom wall shown in FIG. 6, which is inclined such that one side in the right and left direction is lowered. The bottom wall 42 may be inclined with respect to a horizontal plane such that one end in a direction orthogonal to the sheet plane of FIG. 6 is lowered. In addition, the bottom wall 42 may be inclined with respect to a horizontal plane such that one side in the right and left direction in the example shown in FIG. 6 is lowered, and that one end in a direction orthogonal to the sheet plane of FIG. 6 is lowered. The exhaust pipe 46 (first part 461) is opened toward the discharged-water storage unit 40 at a position near an end on one side in the width direction of the bottom wall 42. Herein, the position near the end on one side in the width direction of the bottom wall 42 means an area extending from the end on one side in the width direction of the bottom wall 42 to an inside thereof by 1/10 of a width $W_{42}$ of the bottom wall 42 along the width direction. Since the bottom wall 42 is inclined with respect to a horizontal plane, water stored in the discharged-water storage unit 40 flows toward the one side in the width direction, i.e., toward the exhaust pipe 46 opened into the bottom wall 42, whereby water can be rapidly discharged from the discharged-water storage unit 40.

A ratio ($H_{42}/W_{42}$) of a height $H_{42}$ which is from the lowest portion to the highest portion of the bottom wall 42 (in the example shown in FIG. 6, the height $H_{42}$ from the end on one side in the width direction of the bottom wall 42 to the end on the other side (left side in FIG. 6)) relative to the width $W_{42}$ of the bottom wall 42 may be not less than 1/200 and not more than 1/20, for example. When $H_{42}/W_{42}$ is not less than 1/200, the bottom wall 42 can be appropriately inclined, whereby water can be rapidly discharged from the discharged-water storage unit 40. In addition, when $H_{42}/W_{42}$ is not more than 1/20, the height of the discharged-water storage unit 40 can be held down, whereby enlargement of the discharged-water storage unit 40 can be effectively avoided.

In the example shown in FIG. 6, the water level detectors 44, 45 are both disposed above the position near the end on one side in the width direction of the bottom wall 42. Since the bottom wall 42 is inclined with respect to a horizontal plane such that one side in the width direction is lowered, a depth of water stored in the discharged-water storage unit 40 from the water level down to the bottom wall 42 increases toward the one side in the width direction. In the illustrated example, the water level detectors 44, 45 are disposed on an area in which the depth of water stored in the discharged-water storage unit 40 is relatively large. This is because a water level in the discharged-water storage unit 40 waves by vibrations generated in the air conditioner 10. These waves may make unstable detection of water level by the water level detectors 44, 45. Thus, the water level detectors 44, 45 are disposed on a deep area insusceptible to waves. As a result, the water level detectors 44, 45 can stably detect water levels with minimum wave influence. Thus, detection of water levels by the water level detectors 44, 45 can be stably performed. In addition, by disposing the lower water level detector 44 above the position near the end on one side in the width direction of the bottom wall 42, i.e., by disposing the lower water level detector 44 on an area in which the depth of water in the discharged-water storage unit 40 is relatively large, an amount of water remaining in the discharged-water storage unit 40 can be reduced at a time point at which discharge of water by the pump P is completed (timing D in FIG. 5). Thus, an amount of water that can be discharged once by the pump P is increased, whereby the number of times of activation of the pump P can be reduced. Therefore, an energy amount consumed by the pump P can be effectively reduced.

In the illustrated example, a gap is formed between an end in the width direction of the cooling unit 14 and a side wall 13 of the air flow path 12. A width of the gap, i.e., a separation distance $W_a$ along the width direction between the end in the width direction of the cooling unit 14 and the sidewall 13 of the air flow path 12 may be not less than 100 mm and not more than 200 mm, for example.

The width $W_{42}$ of the bottom wall 42 is preferably the same as a width $W_{14}$ of the cooling unit 14 along the width direction, or larger than the width $W_{14}$ of the cooling unit 14. When the bottom wall 42 has such a width, water droplets falling down from the cooling unit 14 can be more reliably caught.

The air conditioner 10 in this embodiment includes: the air flow path 12, the cooling unit 12 disposed in the air flow path 12, the cooling unit 12 being configured to cool air introduced into the air flow path 12 so as to condense vapor contained in the air; the humidification unit 20 that humidifies the air, the humidification unit 20 having the storage tank 22 for storing water and a heater 24 for heating water in the storage tank 22; the discharged-water storage unit 40 capable of storing water discharged from the cooling unit 14 and water discharged from the humidification unit 20; the exhaust pipe 23 connected to the storage tank 22, the exhaust pipe 23 being configured to discharge water in the storage tank 22 to the discharged-water storage unit 40; and the exhaust valve 35 disposed midway on the exhaust pipe 34; wherein the air conditioner 10 further includes the overflow pipe 38 that connects the storage tank 22 and a part of the exhaust pipe 34 on the downstream side of the exhaust valve 35.

According to such an air conditioner 10, since it has the discharged-water storage unit 40 capable of storing water discharged from the cooling unit 14 and water discharged from the humidification unit 20, water discharged from the humidification unit 20, together with water discharged from the cooling unit 14, can be discharged to the outside of the air conditioner 10 without any manual operation of an operator. Namely, it is possible to automate the discharge operation of water discharged from the humidification unit 20, which saves labor of an operator. In addition, as compared with a case in which a means dedicated for automatically discharging water discharged from the humidification unit 20 to the outside of the air conditioner 10, increase in the number of components constituting the air conditioner 10 and enlargement of the air conditioner 10 can be avoided.

In addition, since the air conditioner 10 has the overflow pipe 38 that connects the storage tank 22 of the humidification unit 20 and a part of the exhaust pipe 34, which is positioned on the downstream side of the exhaust valve 35, even when supply of water from the supply source into the storage tank 22 cannot be stopped because of trouble of the supply valve 33 or the water level detector 26, it can be prevented that the water overflows from the storage tank 22 to enter surrounding units so that the units are damaged, and the air conditioner 10 can have stability in operation.

In the air conditioner 10 in this embodiment, the discharged-water storage unit 40 is the drain pan 41 disposed below the cooling unit 14.

According to such an air conditioner 10, since the drain pan 41 can be used as the discharged-water storage unit 40, increase in the number of components constituting the air conditioner 10 and enlargement of the air conditioner 10 can be further avoided.

In the air conditioner in this embodiment, the bottom wall 42 of the discharged-water storage unit 40 is inclined with respect to a horizontal plane.

According to such an air conditioner 10, since water stored in the discharged-water storage unit 40 can flow along the inclination of the bottom wall 42, the water can be rapidly discharged from the discharged-water storage unit 40.

The air conditioner 10 in this embodiment further has the water level detectors 44, 45 each detects a water level in the discharged-water storage unit 40.

According to such an air conditioner 10, water in the discharged-water storage unit 40 can be discharged based on detection of water level by the water level detectors 44, 45. Thus, discharge of water from the discharged-water storage unit 40 can be automated.

The air conditioner 10 in this embodiment further has the pump P that discharges water stored in the discharged-water storage unit 40.

According to such an air conditioner 10, discharge of water stored in the discharged-water storage unit 40 can be efficiently performed by the pump P. In addition, as shown in FIG. 1, in the semiconductor device manufacturing plant 1, the downstairs part 3 is not equipped with an exhaust channel to the outside of the semiconductor device manufacturing plant 1, and only the upstairs part 2 is equipped with an exhaust channel to the outside of the semiconductor manufacturing plant 1. Even in this case, water stored in the discharged-water storage unit 40 can be delivered to the upstairs part 2 by using the pump P.

The aforementioned embodiment can be variously modified. Herebelow, modification examples are described with reference to the drawings. In the below description and the drawings used in the description, a part having the same structure as that of the above embodiment has the same reference numeral, and description thereof is omitted.

Figure 7:
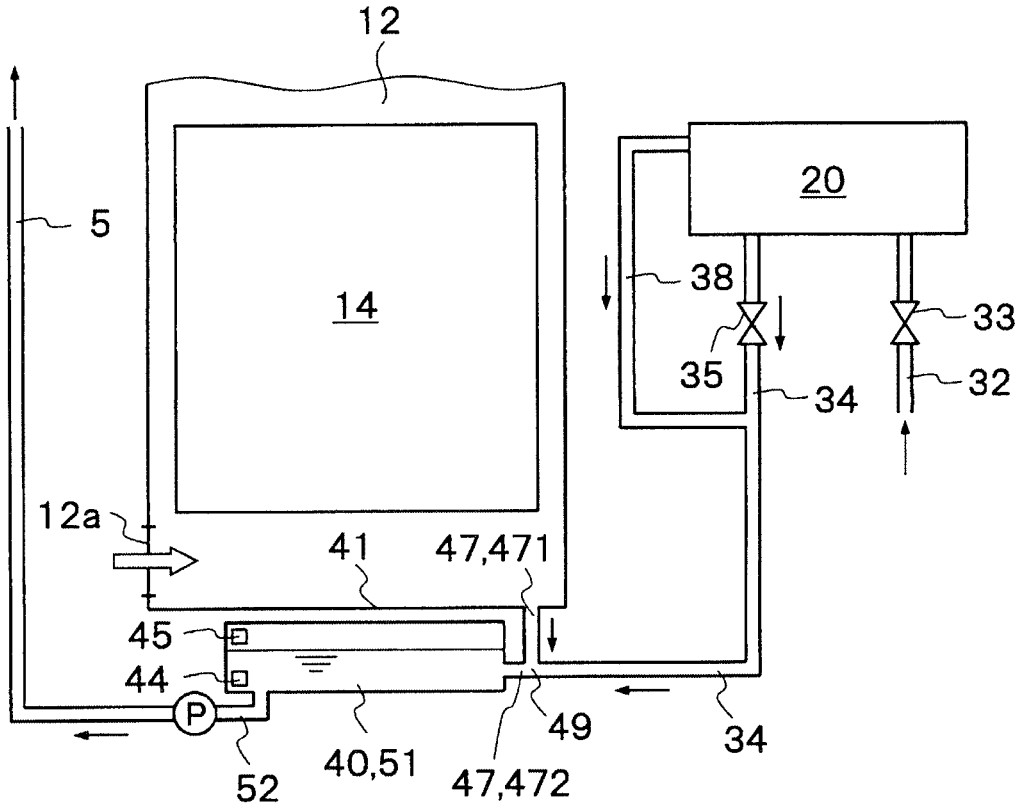
FIG. 7 is a view showing a cooling unit, a humidification unit and a discharged-water storage unit of an air conditioner according to a modification example of the present invention.

A modification example of the air conditioner 10 is described with reference to FIG. 7. FIG. 7 is a view showing a cooling unit 14, a humidification unit 20 and a discharged-water storage unit 40 of an air conditioner 10 according to this modification example.

In the above embodiment, the drain pan 41 is used as the discharged-water storage unit 40. On the other hand, in this modification example, a discharged-water storage unit 40 separated from the drain pan 41 is provided. In the illustrated example, the discharged-water storage unit 40 is structured as a storage tank 51 disposed below the drain pan 41. However, the installation position of the storage tank 51 is not limited to the position below the drain pan 41. An exhaust pipe (third exhaust pipe) 47 for discharging water droplets falling down to the drain pan 41 is connected to the drain pan 41. The exhaust pipe 47 is connected to the storage tank 51 at an end opposed to the end connected to the drain pan 41. In the illustrated example, an exhaust pipe 34 for discharging water in the storage tank 22 of the humidification unit 20 is connected to the exhaust pipe 47 at a connection 49 positioned on an intermediate part of the exhaust pipe 47. Thus, the exhaust pipe 47 has a first part 471 that extends from the drain pan 41 to the connection 49, and a second part 472 that extends from the connection 49 to the storage tank 51. Water droplets adhering to the cooling unit 14 fall down to the drain pan 41 disposed below the cooing unit 14 to flow into the storage tank 51 so as to be stored therein through the exhaust pipe 47. In addition, water discharged from the storage tank 22 of the humidification unit 20 flows into the storage tank 51 so as to be stored therein through the exhaust pipe 34 and the exhaust pipe 47 (second part 472), or through the overflow pipe 38, the exhaust pipe 34 and the exhaust pipe 47 (second part 472).

An exhaust pipe (fourth exhaust pipe) 52 for discharging water stored in the storage tank 51 toward the pump P is connected to the storage tank 51. The exhaust pipe 52 is connected to the pump P at an end opposed to the end connected to the storage tank 51. Since the operation of the pump P is the same as that of the above embodiment, description thereof is omitted.

In the air conditioner 10 according to this modification example, the discharged-water storage unit 40 has the storage tank 51 capable of storing water discharged from the cooling unit 14 and water discharged from the humidification unit 20.

According to such an air conditioner 10, the position of the storage tank 51 of the discharged-water storage unit 40 is not limited to a position below the cooling unit 14. Thus, a degree of freedom in design of the air conditioner 10 can be effectively improved.

As another modification example, the pump P can be structured as a diaphragm-type pump. A discharge amount in each discharge of a diaphragm-type pump is known for every model. In addition, an amount of water stored in the discharged-water storage unit 40 upon detection of a water level by the higher water level detector 45 is substantially constant. Thus, in the above embodiment, an operation time of the pump P or the number of times of operation thereof is set such that after the higher water level detector 45 has detected a water level, the pump P discharges water, an amount of which is estimated as an amount stored in the discharged-water storage unit 40, toward the downstairs exhaust pipe 5, and then stops. In this case, the lower water level detector 44 can be omitted.

In the air conditioner 10 in this modification example, the pump P is a diaphragm-type pump.

According to such an air conditioner 10, since the lower water level detector 44 can be omitted, the number of components constituting the air conditioner 10 can be reduced, which can cut costs of the air conditioner 10.

Some modification examples of the aforementioned embodiment have been described. Naturally, these modification examples can be suitably combined.

What is claimed is:

1. An air conditioner comprising:

an air flow path;

a cooling unit disposed in the air flow path, the cooling unit being configured to cool air introduced into the air flow path so as to condense vapor contained in the air;

a humidification unit that humidifies the air, the humidification unit including a storage tank for storing water and a heater for heating water in the storage tank;

a discharged-water storage unit capable of storing water discharged from the cooling unit and water discharged from the humidification unit;

a first exhaust pipe connected to the discharged-water storage unit, the first exhaust pipe being configured to discharge water stored in the discharged-water storage unit;

a second exhaust pipe having one end connected to the storage tank and another end connected to an intermediate portion of the first exhaust pipe, the second exhaust pipe being configured to discharge water from the storage tank to the discharged-water storage unit;

an exhaust valve disposed midway on the second exhaust pipe; and an overflow pipe that connects the storage tank and a part of the second exhaust pipe on a downstream side of the exhaust valve.

2. The air conditioner according to claim 1, wherein the discharged-water storage unit is a drain pan disposed below the cooling unit.

3. The air conditioner according to claim 1, wherein a bottom wall of the discharged-water storage unit is inclined with respect to a horizontal plane.

4. The air conditioner according to claim 1, further comprising a water level detector that detects a water level in the discharged-water storage unit.

5. The air conditioner according to claim 1, further comprising a pump that discharges water stored in the discharged-water storage unit.

6. The air conditioner according to claim 5, wherein the pump is a diaphragm pump.

* * * * *